US005470068A

United States Patent [19]

Schmidt et al.

[11] Patent Number: 5,470,068

[45] **Date of Patent: * Nov. 28, 1995**

[54] GOLF PUTTER WITH DISHED BOTTOM SURFACES

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Aug. 31, 2010, has been disclaimed.

[21] Appl. No.: 182,423

[22] Filed: Jan. 18, 1994

Related U.S. Application Data

[63] Continuation-in-part of Ser. No. 29,553, Mar. 11, 1993, Pat. No. 5,301,945, which is a continuation of Ser. No. 819,379, Jan. 15, 1992, Pat. No. 5,240,252, which is a continuation-in-part of Ser. No. 791,322, Nov. 14, 1991, Pat. No. 5,180,166, which is a continuation of Ser. No. 595,963, Oct. 16, 1990, Pat. No. 5,067,715, and also a continuation-in-part of Ser. No. 819,940, Jan. 13, 1992, Pat. No. Des. 343,434, Ser. No. 6,184, Mar. 19, 1993, Pat. No. Des. 352,984, Ser. No. 16,772, Jan. 6, 1994.

[51] Int. Cl.[6] ..... A63B 53/04

[52] U.S. Cl. ..... 273/167 A; 273/174

[58] Field of Search ..... 273/167 A–167 E, 273/167 G, 167 H, 167 K, 172, 174, 167 F

[56] References Cited

U.S. PATENT DOCUMENTS

| | | | |
|---|---|---|---|
| D. 94,549 | 2/1935 | Jansky . | |
| D. 225,419 | 12/1972 | Mills . | |
| D. 247,383 | 2/1978 | Adkins . | |
| D. 307,783 | 5/1990 | Iinuma . | |
| D. 318,087 | 7/1991 | Helmstetter . | |
| 1,167,106 | 1/1916 | Palmer . | |
| 1,568,888 | 1/1926 | Dunn . | |
| 1,582,836 | 4/1926 | Link . | |
| 1,619,566 | 3/1927 | Crankshaw . | |
| 1,658,581 | 2/1928 | Tobia . | |
| 1,669,482 | 5/1928 | Miller . | |
| 1,868,286 | 7/1932 | Grieve . | |
| 1,916,792 | 7/1933 | Hadden . | |
| 1,946,208 | 2/1934 | Hampton . | |
| 2,041,676 | 5/1936 | Gallagher . | |
| 2,087,685 | 7/1937 | Hackney . | |
| 2,201,638 | 5/1940 | Theibault, Sr. . | |
| 2,460,435 | 2/1949 | Schaffer . | |
| 2,960,338 | 11/1960 | Havey et al. . | |
| 3,212,783 | 10/1965 | Bradley et al. . | |
| 3,761,095 | 9/1973 | Thompson . | |
| 3,976,299 | 8/1976 | Lawrence et al. . | |
| 4,214,754 | 7/1980 | Zebelean . | |
| 4,313,607 | 2/1982 | Thompson . | |
| 4,325,550 | 4/1982 | Thompson et al. | 273/167 A |
| 4,332,388 | 6/1982 | Crow . | |
| 4,432,549 | 2/1984 | Zebelean . | |
| 4,511,145 | 4/1985 | Schmidt . | |
| 4,653,756 | 3/1987 | Sato . | |
| 4,681,321 | 7/1987 | Chen et al. . | |
| 4,715,601 | 12/1987 | Lamanna . | |
| 4,872,685 | 10/1989 | Sun . | |

(List continued on next page.)

FOREIGN PATENT DOCUMENTS

| | | |
|---|---|---|
| 1476889 | 5/1975 | United Kingdom . |
| 2100993 | 1/1983 | United Kingdom . |
| 2225725 | 6/1990 | United Kingdom . |
| 2230459 | 10/1990 | United Kingdom . |

*Primary Examiner*—Vincent Millin
*Assistant Examiner*—Steven B. Wong
*Attorney, Agent, or Firm*—William W. Haefliger

[57] ABSTRACT

A golf putter head comprising a body having toe and heel portions, a front wall defining a ball-striking face, and top and bottom walls, the bottom wall characterized as having a medial ridge, and as forming two dished shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion, the recesses being located in substantially mirror imaged positions with respect to a forwardly extending vertical plane bisecting the ridge.

18 Claims, 4 Drawing Sheets

U.S. PATENT DOCUMENTS 4,884,812 12/1989 Nagasaki et al. .
4,930,781 6/1990 Allen .
5,026,056 6/1991 McNally et al. .
5,042,806 8/1991 Helmstetter .
5,046,733 9/1991 Antonious .
5,067,715 11/1991 Schmidt et al. .
5,180,166 1/1993 Schmidt et al. .
5,240,252 8/1993 Schmidt et al. .
5,301,945 4/1994 Schmidt et al. ..... 273/167 A

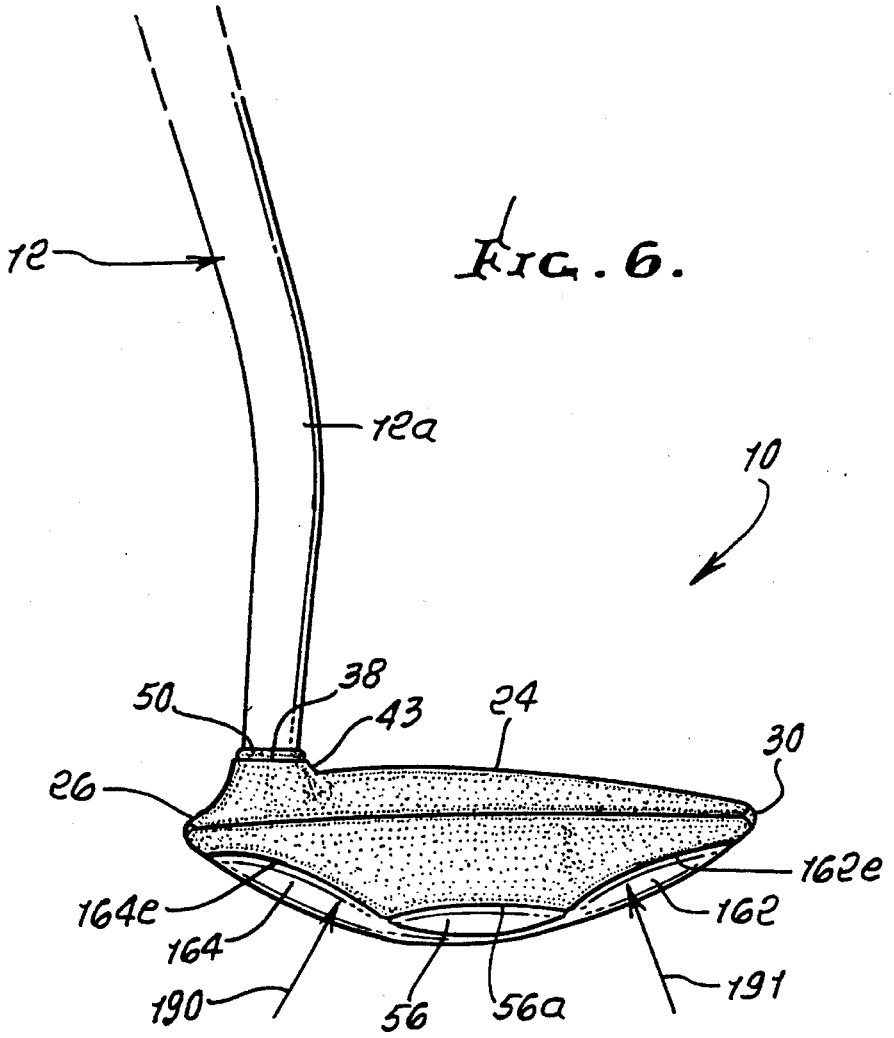
FIG. 6.
FIG. 7.
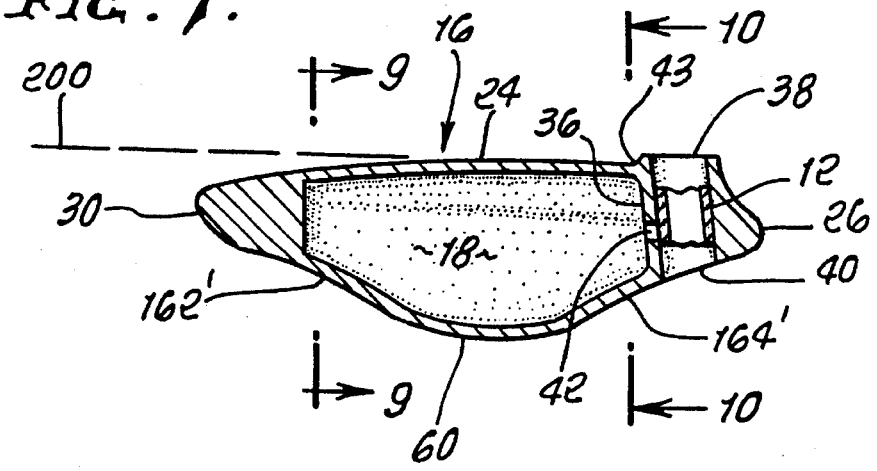

GOLF PUTTER WITH DISHED BOTTOM SURFACES

BACKGROUND OF THE INVENTION

This application is a continuation-in-part of Ser. No. 08/029,553 filed Mar. 11, 1993, now U.S. Pat. No. 5,301,945 issued Apr. 12, 1994, which is a continuation of Ser. No. 07/819,379 filed Jan. 15, 1992, now U.S. Pat. No. 5,240,252 issued Aug. 31, 1993, which is a continuation-in-part of Ser. No. 07/791,322 filed Nov. 14, 1991, now U.S. Pat. No. 5,180,166 issued Jan. 19, 1993, which is a continuation of Ser. No. 07/595,963 filed Oct. 16, 1990, now U.S. Pat. No. 5,067,715 issued Nov. 26, 1991; and also a continuation-in-part of Ser. No. 07/819,940 filed Jan. 13, 1992, now U.S. Pat. No. D343,434; and a continuation-in-part of Ser. No. 29/006,184 filed Mar. 19, 1993, now U.S. Pat. No. D352,984; and a continuation-in-part of Ser. No. 529/016,772 filed Jan. 6, 1994.

There is need to reduce drag forces at bottom walls of putter heads, especially when putters are used to stroke golf heads in turf adjacent or very near golf greens. There is also need to reduce putter bottom wall drag on golf greens, should the putter engage the green during stroking. Also, there is need to centralize such drag to locations rearwardly of the golf ball being stroked.

SUMMARY OF THE INVENTION

It is a major object of the invention to provide structure overcoming the above problems and disadvantages. Basically, the improved putter head of the invention is characterized by a ball striking front wall, a bottom wall, and spaced toe and heel walls, the bottom wall characterized as having two shallow recesses, one recess closer to the heel portion, and the other recess closer to the toe portion, the recesses being everywhere spaced rearwardly from the front wall, the one recess having an arcuate peripheral edge generally convex toward the toe portion.

Such recesses typically have downward facing surfaces with shallow upwardly dished configuration. The downward facing surfaces are concave in front-to-rear directions; and the downward facing surfaces are also concave in directions between the heel and toe.

Another object is to provide a putter bottom wall structure that will aid in "lifting of" a golf ball having a bad lie, adjacent a green, during stroking.

Another object is to provide such a putter head wherein the bottom wall has a locally flattened, rearwardly divergent surface that extends at a rearwardly and upwardly extending angle, beyond rearward extent of a medial ridge, and between rearward extents of the recesses. That flattened surface may merge with peripheries of the dished recesses, as will appear, and at cusps located equidistantly from the putter front face, whereby lift force balance is achieved.

A further object is to provide the putter bottom wall to be in part defined by a sole plate having a peripheral edge rigidly connected to the bounding edge of an opening defined by the bottom wall, rearwardly of the front wall, whereby the sole plate closes the opening, the medial ridge and recesses also being in part defined by the sole plate. In this regard, the sole plate typically defines major extents of the shallow recesses. A head body shell may also define a rigidizing bottom wall corner plate section integral with shaft supporting tube structure, the sole plate also connected to that corner plate section, the corner plate section also forming a portion of the one shallow recess closest to the head heel portion.

Another object is to provide a putter head bottom wall which controls engaged turf relative movement (during a golf swing) so as to create upward force or forces acting on the head in a manner resulting in reduced drag as the head is swung.

Another object is to provide a putter head having a bottom wall having a medial ridge, and forming two dished, similar shallow recesses, one recess between the ridge and putter heel portion and the other recess between the ridge and putter toe portion, such recesses located rearwardly of the putter front wall, one recess having an arcuate peripheral edge portion generally convex toward said heel portion and the other recess having an arcuate peripheral edge portion generally convex toward said toe portion. Each recess may have a downwardly facing surface further characterized in that:

i) a vertical plane bisecting the recess in a toe to heel direction intersects the recess surface along a downwardly concave line, and ii) a vertical plane bisecting the recess in a front to rear direction relative to the head intersects the recess surface along a downwardly concave line.

Also, the two concave recesses of each head typically have similar configuration with respect to a vertical plane that bisects said ridge in a front to rear direction relative to the head. Further each recess may have a downwardly facing surface further characterized in that, i) the rearwardmost extent of said downwardly facing surface is inclined forwardly and upwardly relative to the head forward swing path as the head bottom wall engages the turf, ii) whereby lift force is created in response to engagement of that rearwardmost extent of said surface with the turf as the head is swung forwardly along said path, such lift force acting to urge the head bottom wall and the head in an upward direction.

Yet another object is to provide a putter bottom wall having a rearwardly divergent surface (which may be locally flattened) that extends at a rearwardly and upwardly extending angle, beyond rearward extent of said ridge, and between rearward extents of said recesses, for reducing drag as the head is swung forwardly in an arc, adjacent the turf. In this regard, guided engagement with the turf and upward force exertion are enhanced by a configuration wherein the rearwardly divergent surface and the two recesses have edges which, when viewed from the rear of the head, are upwardly convex. Also, there may be provided a substantially continuous, hollow, metallic tube extending within the shell of the heel portion and from proximate the shell top wall to proximate the shell bottom wall, that tube having a bore to receive a club shaft, the bore aligned with the one shallow recess.

These and other objects and advantages of the invention, as well as the details of an illustrative embodiment, will be more fully understood from the following specification and drawings, in which:

DRAWING DESCRIPTION

FIG. 6 is a rear elevation of the FIG. 1 head;

FIG. 7 is a section in elevation on lines 7—7 of FIG. 5;

DETAILED DESCRIPTION

Figure 1:
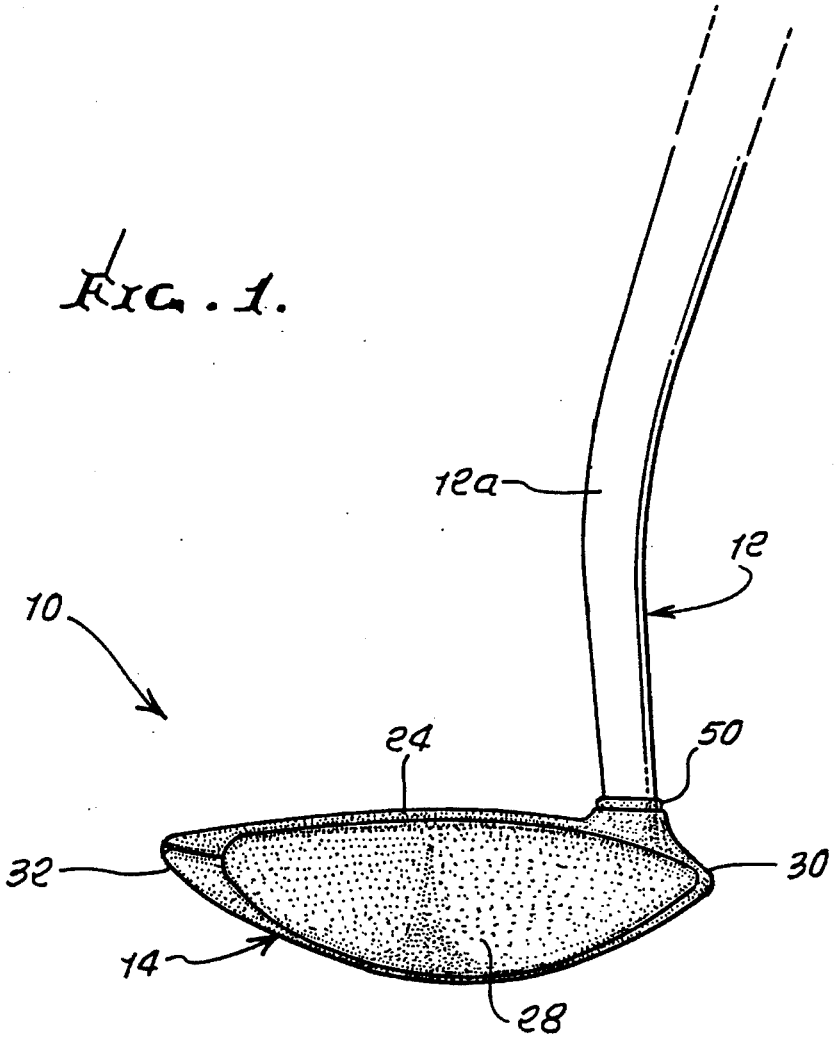
FIG. 1 is a front face view of the putter head.

Referring now to the drawings, a putter 10, in accordance with a preferred embodiment of the present invention, is shown. It includes a shaft 12 bi-directionally curved to form a knee 12*a*, and having a lower portion which is attached to putter head 14. The head 14 is in the configuration of a "wood" club, although it is made of metal. As shown in FIGS. 7–10, the body of the head comprises a hollow metal shell 16, which may be filled with a plastic foam filling 18, preferably polyurethane.

The shell 16 is preferably made of stainless steel, and it may be fabricated by the "lost wax" casting method that is well-known in the art. The shell 16 may be formed in two pieces: a main upper portion 20, and a sole plate 22 that is peripherally welded to the main portion 20, and as will be referred to.

Figure 2:
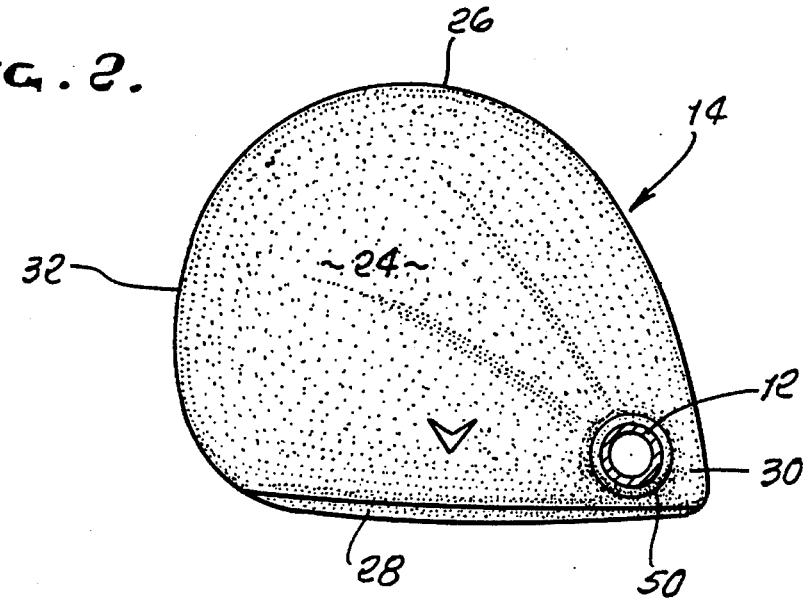
FIG. 2 is a top plan view of the FIG. 1 head.
Figure 3:
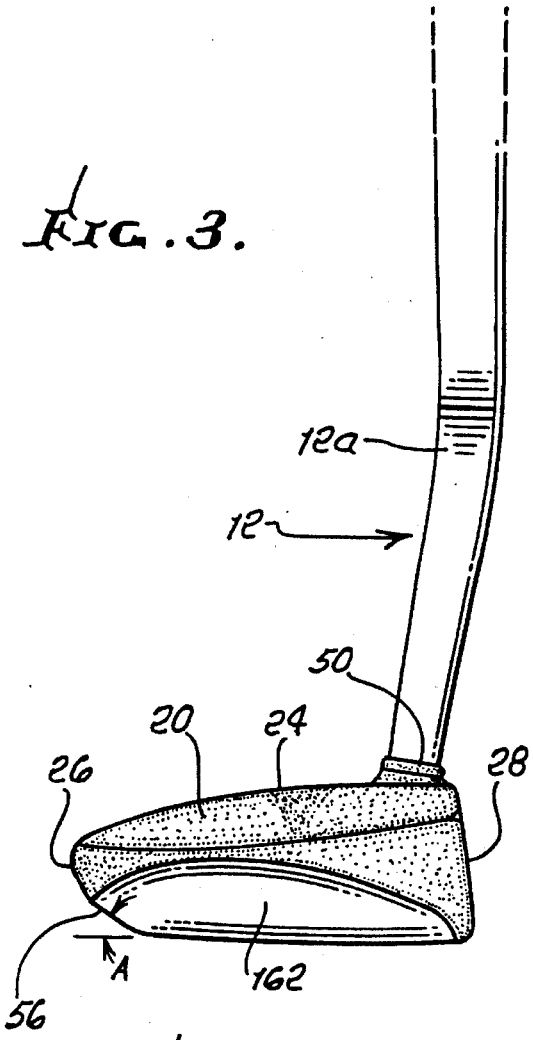
FIG. 3 is a toe end view of the FIG. 1 head.

The main shell portion 20 has a top surface 24, a rear surface 26, and a ball-striking surface or face 28 opposite the rear surface 26. The face 28 is angled with respect to the vertical with a specified "pitch" that is determined by the amount of loft desired. The end portion of the head 14 proximate the shaft 12 is commonly termed the "heel" 30, while the end portion opposite the heel 30 is termed the "toe" 32. As shown in FIG. 2, the head body is typically convexly curved from the heel 30 to the toe 32, at the rear side of the head. The main shell portion 20 has a bottom corner portion 34 (shown in FIG. 5) that is cast integrally with the front wall 28*a* and with the heel wall 30*a*, and flush with the sole plate 22, and that forms a bottom surface or sole in combination with the sole plate 22 when the two shell portions are welded together.

Referring now to FIG. 7, the shell 16 is provided with a substantially continuous hollow tube 36 that extends from an upper opening 38 in the top surface 24 to a lower opening 40 in the bottom surface or sole through the bottom corner portion 34 of the main shell portion 20. The tube 36 side wall is interrupted by an internal orifice 42 that opens into the interior of the shell. The orifice 42 provides an entrance for the introduction of the foam material 18 into the shell interior during the manufacturing process.

The tube 36 is dimensioned to receive the lower part of the shaft 12 with a snug fit. The upper opening 38 is provided with a radiused lip 43, as shown in FIG. 7, to minimize the possibility of stress fractures in the shaft due to impact against the edge of the opening. A portion of the interior wall of the tube 36, extending downwardly from the upper opening 38, may be provided with striations, preferably in the form of internal threads, or a series of concentric steps, to provide a "glue lock" for better bonding of the shaft in the tube.

In the preferred embodiment of the invention, the lip 43 is at the end of a slight rise at the heel end of the head, the height of the rise being less than, or approximately equal to, the height of a horizontal plane 200 defined by the highest point of the club head top surface 24.

The shaft 12 is a hollow tube made of any suitable material. Steel is the most common material, but titanium and graphite-boron may also be used. If the shaft is of steel, the exterior of the shaft may be chrome-plated to minimize corrosion. The lower part of the shaft may be fitted with a plug 46 to prevent the entry of moisture into the interior of the shaft. The plug 46 may be of any suitable resilient material, such as Nylon, epoxy, polyurethane, or Delrin. The plug 46 may be retained in the shaft by an annular crimp in the shaft wall. The crimp also serves as a glue lock. A locator ring 50, preferably of glass fiber-reinforced nylon, is adhesively bonded to the shaft at a distance above the bottom end of the shaft approximately equal to the length of the tube 36.

Figure 4:
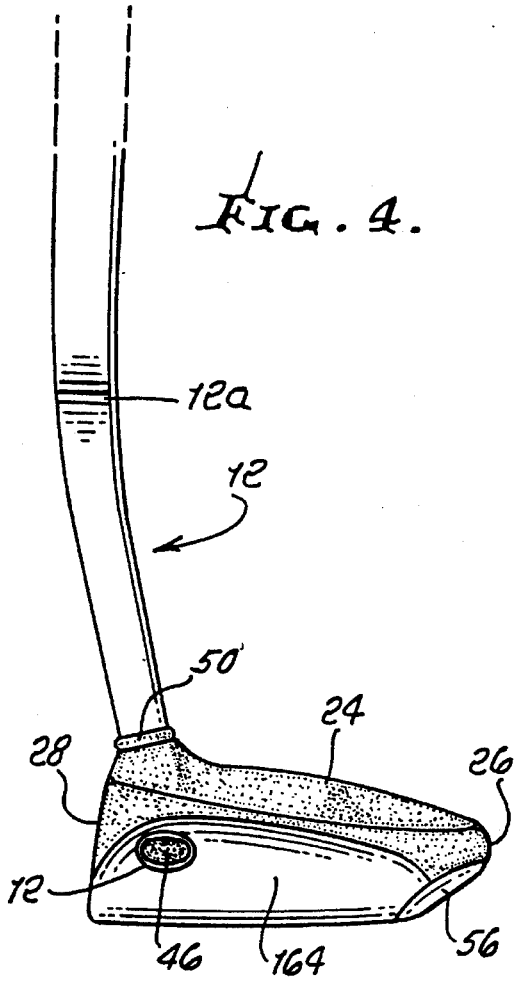
FIG. 4 is a heel end view of the FIG. 1 head.
Figure 5:
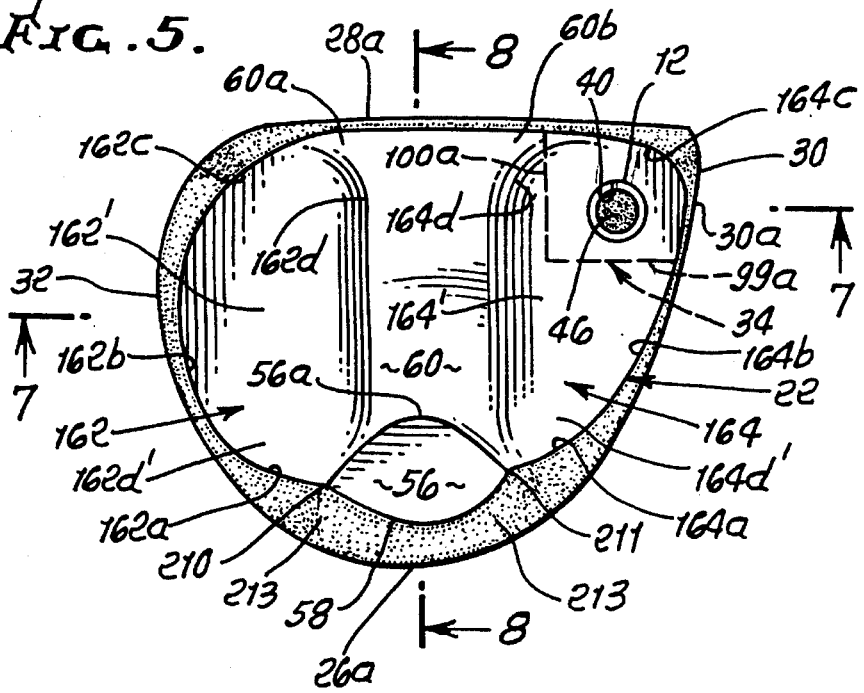
FIG. 5 is a bottom plan view of the FIG. 1 head.
Figure 8:
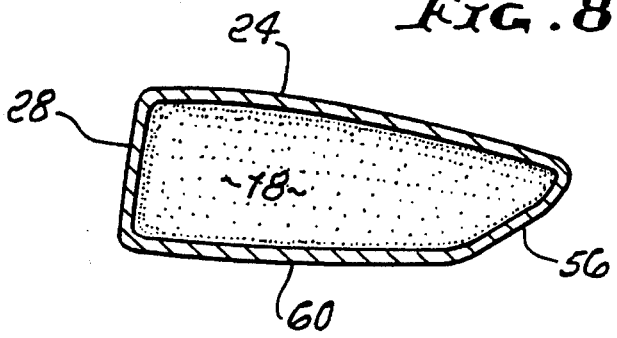
FIG. 8 is a section in elevation on lines 8—8 of FIG. 5.

The shaft 12 may be attached to the head 14 by a suitable epoxy adhesive, the steps or threads in the tube 36 and a crimp in the shaft providing "glue locks" as mentioned above, for better adhesive bonding. (Any plating on the lower part of the shaft is first buffed off.) During assembly, the lower part of the shaft is inserted into the tube 36 until the locator ring 50 abuts against the radiused lip 43 at the upper tube opening 38. The bottom end of the shaft 12 then extends slightly beyond the lower tube opening 40. The shaft bottom end is then cut and ground so as to be flush with the sole of the head, as shown in FIGS. 4 and 5.

The structure described above allows the shaft to be attached to the head without a neck or hosel. As a result, substantially all of the mass of the head is "effective mass" that contributes to the transfer of energy from the player to the ball. By increasing the effective mass of the club head, there is a more effective transfer of energy to the ball from the player, yielding increased putting distance without an increase in effort on the part of the player. This can be important for large greens and also where the ball lies in grassy turf near a green edge, where the putter is used to stroke the ball.

Moreover, without an external hosel, the lower part of the shaft may extend all the way through the head, with the bottom end of the shaft terminating flush with the sole. Thus, by eliminating the external hosel, the shaft both enters, and may exit the head, within the area defined between the top and bottom of the face of the putter head, which area is sometimes called the "ball control zone". By bringing the lower end of the shaft within the control zone, and extending the shaft deeply into the head shell, for example through to the sole of the head, the tactile sense of the location of the putter face, or "head feel" is maximized, yielding increased control of the shot, greater ability of the skilled player to "work" the ball, and a more solid feel of impact with the ball regardless of where on the face the ball is struck. The increase in effective mass of the head, plus the rigid support for the lower end of the shaft, provided by the internal tube 36 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the head where it can contribute to the effective mass of the head without increasing the total head mass. Optimally, this mass can be added by increasing the overall size of the putter head.

Still another advantage of eliminating the hosel is that there is a more even cooling of the putter head in the mold. Where there is an upward hosel, by comparison, the hosel and the rest of the head shell may cool at unequal rates, thereby resulting in a slight warping that can produce a lack of uniformity in loft, lie, and face angle from club head to club head.

A golf putter, in accordance with a preferred embodiment of the invention, includes the sole configuration shown in the drawings.

As shown in the drawings, the bottom wall is characterized as forming a medial ridge 60, and as forming two shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion. Examples of such shallow, upwardly dished recesses are seen at 162 between the ridge 60 and the toe 32, and at 164 between the ridge and heel 30.

Recess 162 curved periphery, extends in a looping edge path, indicated at 162*a*, 162*b*, 162*c*, and 162*d*, and recess 164 also extends in a looping edge path indicated at 164*a*, 164*b*, 164*c*, and 164*d*, both paths located on the bottom wall, as shown. The maximum depth of each recess below a plane containing its peripheral looping edge path is less than ¼ inch, and preferably between 1/16 inch and 3/16 inch. These depths are sufficient to avoid direct frictional contact of recess dished inner surfaces 162' and 164' with the ground during a club stroke, ground contact, if any, being confined to the lowermost extent of the central ridge 60. Also, the upward bi-directional concavity of the bottom wall extents 162' and 164' forming the recesses adds to bottom wall strength, and stiffness, for transmitting loading transmitted to and from the front wall 28 during ball stroking. The bottom wall thickness may then be minimized and metal "redistributed" to enable provision of a larger sized head.

Note also the provision of a bottom wall rearwardly divergent surface that extends at a rearwardly and upwardly extending angle, beyond rearward extent of the ridge, and between rearward extents of the recesses.

Specifically, there is a trailing surface 56, which is a relieved, upwardly angled, somewhat flattened portion extending upwardly from a curved edge 56*a* and between that edge and the center of the sole and a trailing edge 58 at the juncture between the rear surface 26 of the club head and the sole plate 22. The lowermost curved part 56*a* of the surface 56 is contiguous with the rearward end of ridge 60 that extends forward toward and diverges at 60*a* and 60*b* to merge laterally with the bottom U-shaped edge of the face 28 of the club head.

The trailing surface 56 preferably extends at an angle A of approximately 18° with respect to the horizontal. The angle A may be varied by plus or minus up to 5 degrees, depending on the type of club and the preference of the player. The trailing surface 56 minimizes the club head's closing, or "hooding", when the ball is stroked "fat" while reducing the overall drag of the head if the head engages the turf. Further, in regard to the described combination of bottom wall contours, the ridge downward curvature rearwardly of the front face, and between the dished recesses 162 and 164 enables the sole to penetrate the turf, resisting and repelling the turf against the dished out zones 162 and 164 to limit penetration in proportion to or accordance with the unique shape of the sole as a unit, in a unique way, the front face having a downward U-shape forward of the recesses and ridge, as is clear from FIG. 1. Note the ridge diverging forwardly toward the U-shaped front face.

Accordingly, a golf ball having a "bad lie" next to a green can be approached in a confident way, to "dig" the ball out by means of a club stroke characterized in that the club head sole planes over the turf, considering the turf as fluid. For a golf ball having a more conventional lie, no "digging out" is required, and an improved downward sole shape "footprint" is produced on the turf, as will be referred to.

Referring to FIGS. 2, 5 and 7, internal hosel tube 36 extends downwardly into the hollow interior of the heel portion of the head, and is adapted to receive a shaft 12. Thus, the weight of the hosel is concentrated more directly behind, or close to, the rear side of front wall 28, near the heel, to contribute to the ball-striking mass of the front wall. Also, the hosel tube cylindrical wall reinforces the junction of the front wall, bottom wall, and heel wall. See also rigidizing hosel webbing or filleting 34 which forms the corner plate section of the bottom wall 22. Corner section also forms a portion of the dished portion of the bottom wall recess 164. When the sole plate is attached to the shell, a weld may be formed along edges 99*a*, and 100*a*. See FIG. 5.

A further important aspect of the invention concerns the provision of a golf putter head having a metal shell defining top, bottom, front, rear, toe, and heel walls, and wherein:

a) the bottom wall has upwardly dished wall extent, b) said upwardly dished wall extent defining downward facing surface means inclined forwardly and upwardly relative to the head swing path as the bottom wall engages the turf, so that the turf moving relatively rearwardly engages said inclined surface means for creating lift force acting to urge the bottom wall and the head in an upward direction, whereby drag is reduced and more kinetic energy is available for transfer to the ball.

Further, and as described, the bottom wall also has a downward facing medial ridge 60 which extends generally forwardly, said dished wall extent preferably including two dished extents 162 and 164, respectively, located at opposite sides of said ridge, each of said two dished extents defining a portion of said inclined surface means (at the rears of said dished extents 162 and 164) whereby upward lift forces are developed at opposite sides of said ridge, for torsionally balanced upward lift imparted to the head.

Finally, the turf controlling head bottom wall can be formed or cast integrally with the remainder of the head, if desired, i.e., it need not be separately formed and later welded to a rim defined by a separately cast head. Such forming may be by a casting or molding process employing metallic or non-metallic material.

The bottom wall and/or the rest of the head can be made of materials other than metal.

As used herein, the word "turf" shall be understood to mean grass, weeds, sand, mud, and other material engageable and displaceable by the bottom wall of the head.

Figure 9:
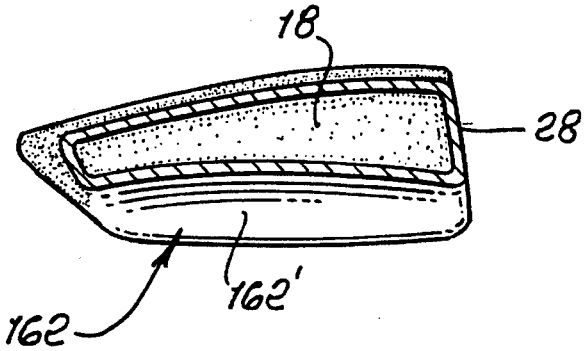
FIG. 9 is a section in elevation on lines 9—9 of FIG. 7.
Figure 10:
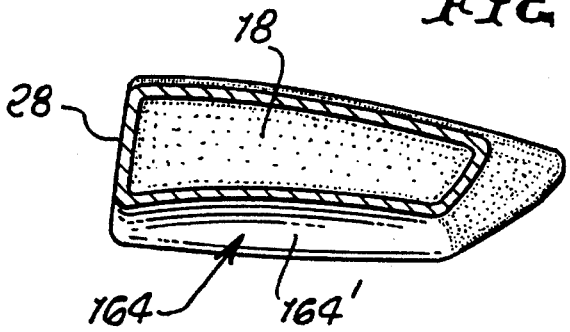
FIG. 10 is a section taken in elevation on lines 10—10 of FIG. 7.

Each recess 162' and 164' as referred to has a downward facing surface and is further characterized in that, i) a vertical plane bisecting the recess in a toe to heel direction intersects the recess surface along a downwardly concave line (see FIG. 7), and ii) a vertical plane bisecting each recess in a front to rear direction relative to the head intersects the recess surface along a downwardly concave line (see FIGS. 9 and 10). Further and as shown, the two recesses of each head have similar configuration (see FIG. 5) with respect to a vertical plane (the plane of FIG. 8) that bisects said ridge in a front to rear direction relative to the head.

It will also be seen that each recess has a downward facing surface, and is further characterized in that:

i) the rearwardmost extents 162*d'* and 164*d'* of said downwardly facing surfaces are inclined forwardly and upwardly relative to the head forward swing path as the head bottom wall engages the turf, ii) whereby balanced lift forces are created in response to engagement of said rearwardmost extents of said surfaces with the turf as the head is swung forwardly along said path, said lift forces acting to urge said head bottom wall and the head in an upward direction.

The medial ridge 60 increases in width at 60*a* and 60*b* toward the front wall and between forward extents of the two recesses 162 and 164. Beyond rearward extent of the ridge, the bottom wall has a rearwardly divergent surface 56 that extends rearwardly and upwardly, that surface for example being flattened, and that surface merging with the recesses at cusps that are substantially equidistant from the head front wall, contributing to balanced lift force creation.

Referring to FIG. 6, the recesses 162 and 164 have edges 162*e* and 164*e* which, when viewed from the rear of the head, are upwardly convex. The rearward edge 56*a* of flattened beveled surface 56 is also upwardly convex in FIG. 6, and located approximately mid-way between edges 162*e* and 164*e*. Such convex edges extend in an arcuate row, as seen in FIG. 6, and define a V-shape. Upward lift force vectors appear at 190 and 191, and result from engagement of the inclined rear portions of the inclined rear portions of the dished recess surfaces with the turf, as referred to above. Note that the vectors are angled upwardly and toward one another.

Referring again to FIG. 5, the head is further characterized by the following:

i) the dished recesses 162 and 164 are located in substantially mirror imaged position with respect to a forwardly extending, vertical plane (the plane of FIG. 8) bisecting the ridge 60;

ii) the convergent rearward terminus of dished recess rearwardmost extent 162*d'* is intersected by a cusp 210 defined by surface or bevel 56; and the convergent rearward terminus of dished recess rearwardmost extent 164*d'* is intersected by a cusp 211 also defined by bevel 56. These cusps are further defined by intersection of the bevel with head rounded outer bottom surface 213 and intersection of the bevel with the ridge rearwardmost and rearwardmost divergent extents, as shown. The cusps 210 and 211 are substantially equidistant from the head front face 28, whereby the bevel is centered between the rearwardmost extents 162*d'* and 164*d'* of the recesses, iii) the cusps 210 and 211 are located at substantially equal distances from the bisecting plane of FIG. 8; that plane also intersects the rearwardmost extent 26*a* of the head. Note the ridge 60 is divergent, forwardly.

The above features contribute to the balanced lift force creation discussed above.

From the above and as shown in the drawings the medial ridge as, for example, at 60 faces downwardly during striking of a ball, and is spaced below the levels of the dished recesses as at 162 and 164. Also, the ridge is seen as in FIG. 9 to have rearwardly elongated length at substantially the same elevation. FIG. 7 shows the ridge 60 to be downwardly convex in a toe to heel direction along its length, to define ridge sidewalls merging with the recesses 162 and 164. FIG. 5 shows the ridge 60 as diverging endwise.

We claim:

1. A golf putter head comprising a body having toe and heel portions, a front wall defining a ball-striking face, and top and bottom walls, said bottom wall characterized as having a medial ridge, and as forming two dished shallow recesses, one recess between the ridge and the heel portion, and the other recess between the ridge and the toe portion, said recesses everywhere spaced rearwardly from said front wall, the one recess having an arcuate peripheral edge generally convex in a toe to heel direction toward said heel portion, and the other recess having an arcuate peripheral edge generally convex toward the toe portion, said recesses being located in substantially mirror imaged positions with respect to a forwardly extending vertical plane bisecting said ridge, said ridge being downwardly convex rearwardly of said front wall to form opposite sides having forward extents diverging in a direction toward said front wall and rearward extents diverging in a rearward direction; said forward and rearward extents being at substantially the same elevation.

2. The putter head of claim 1 wherein said medial ridge increases in width toward said front wall and between forward extents of said recesses.

3. The putter head of claim 1 wherein said bottom wall has a rearwardly divergent surface that extends at a rearwardly and upwardly extending angle, beyond rearward divergent extent of said ridge, and between rearward extents of said recesses.

4. The putter head of claim 3 wherein said recesses have downward facing surfaces with shallow upwardly dished configuration.

5. The putter head of claim 1 wherein said bottom wall is in part defined by a sole plate having a peripheral edge rigidly connected to the bounding edge of an opening defined by said bottom wall, whereby the sole plate closes said opening, said ridge and recesses being in part defined by the sole plate.

6. The putter head of claim 1 wherein said recesses have surfaces that merge in arcuate sloping relation with opposite sides of said ridge.

7. The putter head of claim 1 wherein the body defines a shell forming said top and bottom walls, there being a substantially continuous, hollow, metallic tube extending within the shell and from proximate the shell top wall toward the shell bottom wall, said tube having a bore to receive a club shaft, said bore aligned with said one shallow recess.

8. The putter head of claim 4 wherein said downward facing surfaces are concave in front-to-rear directions.

9. The putter head of claim 8 wherein said downward facing surfaces are also concave in directions between the heel and toe.

10. A golf putter head comprising a body having toe and heel portions, a front wall defining a ball-striking face, and top and bottom walls, said bottom wall characterized as having a medial ridge, and as forming two dished shallow recesses, one recess between the ridge and the heel portion, and the other recess between the ridge and the toe portion, said recesses everywhere spaced rearwardly from said front wall, the one recess having an arcuate peripheral edge generally convex toward said heel portion, and the other recess having an arcuate peripheral edge generally convex toward the toe portion, said recesses being located in substantially mirror imaged positions with respect to a forwardly extending vertical plane bisecting said ridge, the body defining a shell forming said top and bottom walls, there being a substantially continuous, hollow, metallic tube extending within the shell and from proximate the shell top wall toward the shell bottom wall, said tube having a bore to receive a club shaft, said bore aligned with said one shallow recess and wherein said bottom wall includes a sole plate peripherally connected to a shell rim defining a bottom opening, said sole plate defining major extents of said shallow recesses, said shell defining a bottom wall corner plate section integral with said tube, said sole plate also connected to said corner plate section, said corner plate section forming a portion of said one shallow recess between said ridge and heel portion.

11. A golf putter head comprising a body having toe and heel portions, a front wall defining a ball-striking face, and top and bottom walls, said bottom wall characterized as having a medial ridge, and as forming two dished shallow recesses, one recess between the ridge and the heel portion, and the other recess between the ridge and the toe portion, said recesses everywhere spaced rearwardly from said front wall, the one recess having an arcuate peripheral edge generally convex toward said heel portion, and the other recess having an arcuate peripheral edge generally convex toward the toe portion, said recesses being located in substantially mirror imaged positions with respect to a forwardly extending vertical plane bisecting said ridge and wherein the ridge is downwardly convex in a toe to heel direction rearwardly of said front wall and co-acts with said recesses during a club stroke to direct the turf toward and into the recesses, the recesses having surfaces inclined forwardly and upwardly to be engaged by the turf moving relatively rearwardly, for creating lift forces at opposite sides of the ridge, urging the bottom wall and head in an upward direction.

12. The putter head as defined in claim 1 wherein said two recesses of each head have similar configuration with respect to said vertical plane that bisects said ridge in a front to rear direction relative to the head.

13. The putter head as defined in claim 1 wherein each recess has a downward facing surface, and is further characterized in that:

i) the rearwardmost extent of said downwardly facing surface is inclined forwardly and upwardly relative to the head forward swing path as the head bottom wall engages the turf, ii) whereby lift force is created in response to engagement of said rearwardmost extent of said surface with the turf as the head is swung forwardly along said path, said lift force acting to urge said head bottom wall and the head in an upward direction.

14. The putter head as defined in claim 1, wherein said bottom wall has a rearwardly divergent surface that extends at a rearwardly and upwardly extending angle, beyond rearward extent of said ridge, and between rearward extents of said recesses, said surface merging with rearwardmost extents of said recesses at cusps, said cusps spaced substantially equidistantly from the head front wall.

15. The putter head as defined in claim 14 wherein said body is a shell, and there is a substantially continuous, hollow, metallic tube extending within the shell of the heel portion and from proximate the shell top wall to proximate the shell bottom wall, said tube having a bore to receive a club shaft, said bore aligned with said one shallow recess.

16. The putter head as defined in claim 15 including said shaft which projects upwardly from the head with bi-directional curvature to define a knee.

17. The putter head as defined in claim 16 wherein the head front wall defines a sweet spot, and said shaft has an upper extent above said knee which defines an axis directed at the head, rearwardly of the sweet spot.

18. In a golf putter head having a shell and defining top, bottom, front, rear, toe and heel walls, and a shell interior, the combination that includes:

a) the bottom wall having upwardly dished wall extent, b) said upwardly dished wall extent having downwardly facing surface means inclined forwardly and upwardly relative to the head swing path as the bottom wall engages the turf, so that the turf moving relatively rearwardly engages said inclined surface means for creating lift force acting to urge the bottom wall and the head in an upward direction, c) the head having a club shaft-receiving hosel having an axis that projects to intersect said dished wall extent, d) said bottom wall also having a downward facing medial ridge which is downwardly convex in a toe to heel direction throughout its elongated extents extends generally forwardly, said dished wall extent including two dished extents each defining a portion of said inclined surface means whereby upward lift forces are developed at opposite sides of said ridge, said convex ridge having opposite sides merging with said two dished extents, e) said dished extents defining shallow recesses.

* * * * *